US007589752B2

(12) United States Patent
Janning

(10) Patent No.: US 7,589,752 B2
(45) Date of Patent: Sep. 15, 2009

(54) TWO-SIDED THERMAL PRINTING

(75) Inventor: John L. Janning, Dayton, OH (US)

(73) Assignee: NCR Corporation, Dayton, OH (US)

( * ) Notice: Subject to any disclaimer, the term of this patent is extended or adjusted under 35 U.S.C. 154(b) by 403 days.

(21) Appl. No.: 11/314,613

(22) Filed: Dec. 21, 2005

(65) Prior Publication Data

US 2006/0159503 A1 Jul. 20, 2006

Related U.S. Application Data

(60) Provisional application No. 60/644,772, filed on Jan. 15, 2005.

(51) Int. Cl.
*B41J 2/325* (2006.01)

(52) U.S. Cl. ..... 347/171

(58) Field of Classification Search ..... 347/171, 347/172, 173, 183; 400/120.01, 120.07
See application file for complete search history.

(56) References Cited

U.S. PATENT DOCUMENTS

| | | | | |
|---|---|---|---|---|
| 3,947,854 | A | 3/1976 | Hansen et al. | |
| 4,167,392 | A | 9/1979 | Defago | |
| RE30,116 | E | 10/1979 | Maalouf | |
| 4,309,255 | A | 1/1982 | Gendler et al. | |
| 4,507,669 | A | 3/1985 | Sakamoto et al. | |
| 4,708,500 | A | 11/1987 | Bangs et al. | |
| 4,806,950 | A * | 2/1989 | Sekine et al. | 347/185 |
| 4,956,251 | A | 9/1990 | Washizu et al. | |
| 4,965,166 | A | 10/1990 | Hosoi et al. | |
| 5,055,373 | A | 10/1991 | Saeki et al. | |
| 5,101,222 | A | 3/1992 | Hakkaku | |
| 5,132,704 | A | 7/1992 | Nakagawa | |
| 5,196,297 | A | 3/1993 | Dombrowski, Jr. et al. | |
| 5,214,750 | A | 5/1993 | Minowa et al. | |
| 5,266,550 | A | 11/1993 | Asajima et al. | |
| 5,284,816 | A | 2/1994 | Stephenson | |
| 5,398,305 | A | 3/1995 | Yawata et al. | |
| 5,428,714 | A | 6/1995 | Yawata et al. | |
| 5,437,004 | A | 7/1995 | Miyasaka et al. | |
| 5,555,349 | A | 9/1996 | Miyasaka et al. | |
| 5,584,590 | A | 12/1996 | Ito et al. | |

(Continued)

FOREIGN PATENT DOCUMENTS

| | | |
|---|---|---|
| EP | 0947340 | 10/1999 |

(Continued)

OTHER PUBLICATIONS

JP Abstract, vol. 007,No. 062 (M-200), Mar. 16, 1983 & JP 57-208298 A (Ricoh KK), Dec. 21, 1982.

(Continued)

*Primary Examiner*—Huan H Tran
(74) *Attorney, Agent, or Firm*—Robert L. Clark; Charles Q. Maney

(57) ABSTRACT

Dual-sided direct thermal printing of a thermal imaging element having thermally sensitive coatings on opposite sides of a substrate is described, where the thermal imaging element is provided along a feed path of a thermal printer having print heads disposed on opposite sides of the feed path. Printing on both sides of the thermal imaging element is achieved by applying variable energy heat pulses from the opposed print heads.

20 Claims, 4 Drawing Sheets

U.S. PATENT DOCUMENTS

| | | | |
|---|---|---|---|
| 5,594,653 | A | 1/1997 | Akiyama et al. |
| 5,629,259 | A | 5/1997 | Akada et al. |
| 5,639,169 | A | 6/1997 | Aruga |
| 5,677,722 | A | 10/1997 | Park |
| 5,692,110 | A | 11/1997 | Miyasaka et al. |
| 5,707,925 | A | 1/1998 | Akada et al. |
| 5,710,094 | A | 1/1998 | Minami et al. |
| 5,755,521 | A | 5/1998 | Ito et al. |
| 5,756,188 | A | 5/1998 | Reiter et al. |
| 5,763,356 | A | 6/1998 | Ueno et al. |
| 5,789,340 | A | 8/1998 | Brust et al. |
| 5,792,725 | A | 8/1998 | Simpson et al. |
| 5,794,530 | A | 8/1998 | Dobashi et al. |
| 5,800,081 | A | 9/1998 | Teradaira et al. |
| 5,815,191 | A | 9/1998 | Michielsen et al. |
| 5,846,900 | A | 12/1998 | Reiter et al. |
| 5,876,836 | A | 3/1999 | Imamura et al. |
| 5,883,043 | A | 3/1999 | Halbrook, Jr. et al. |
| 5,886,725 | A | 3/1999 | Miyadera et al. |
| 5,918,910 | A | 7/1999 | Stillwagon et al. |
| 5,964,541 | A | 10/1999 | Murison et al. |
| 6,095,414 | A | 8/2000 | Long et al. |
| 6,130,185 | A | 10/2000 | Narita et al. |
| 6,150,067 | A | 11/2000 | Koike et al. |
| 6,210,777 | B1 | 4/2001 | Vermeulen et al. |
| 6,388,692 | B1 | 5/2002 | Iwata et al. |
| 6,562,755 | B1 | 5/2003 | Halbrook, Jr. et al. |
| 6,759,366 | B2 * | 7/2004 | Beckerdite et al. ..... 503/200 |
| 6,784,906 | B2 * | 8/2004 | Long et al. ..... 347/171 |

FOREIGN PATENT DOCUMENTS

| | | |
|---|---|---|
| GB | 2 250 478 | 6/1992 |

OTHER PUBLICATIONS

JP Abstract, vol. 007, No. 081 (M-105), Apr. 5, 1983 & JP 58-008668 A (Shinko Denki KK), Jan. 18, 1983.

JP Abstract, vol. 015, No. 194 (M-1114), May 20, 1991 & JP 03-051149 A (Fujitsu General Ltd.), Mar. 5, 1991.

JP Abstract, vol. 2000, No. 24, May 11, 2001 & JP 2001-199095 A (Alps Electric Co. Ltd.), Jul. 24, 2001.

JP Abstract, vol. 1998, No. 08, Jun. 30, 1998 & JP 10-076713 A (Sony Corp.), Mar. 24, 1998.

JP Abstract, vol. 010, No. 151 (M-483), May 31, 1986 & JP 61-003765 A (Konishiroku Shashin Kogyo KK), Jan. 9, 1986.

JP Abstract, vol. 016, No. 041 (M-1206), Jan. 31, 1992 & JP 03-246091 A (Canon Inc.), Nov. 1, 1991.

Boca Systems Micro Plus 2S 2 Sided Printer product brochure which came to the attention of Applicant at a Chicago tradeshow during the summer of 2002.

* cited by examiner

TWO-SIDED THERMAL PRINTING

CROSS REFERENCE TO RELATED APPLICATION

Benefit of priority is claimed based on U.S. Provisional Application No. 60/644,772 of John L. Janning filed Jan. 15, 2005.

BACKGROUND

Direct thermal printing is a recognized means of printing quietly without toners or inks. It is a relatively mature technology that has been around for over forty years. Its use by retailers for printing of cash register receipts, mailing labels, etc. is now commonplace.

An example of early one-sided direct thermal printing is the thermal half-select printing as taught in U.S. Pat. Nos. 3,466,423 and 3,518,406 to John L. Janning. Such thermal half-select printing was accomplished by energization of electrically resistive thermal printing elements on both sides of thermal printing paper at the same time. The dual-sided coincident electrical current energization energy is additive to produce one-sided printing. The applied energy levels were such that, if applied on one side only, they were not sufficient enough to cause printing. By applying sufficient heat on both sides of the media simultaneously, the applied energies added and one-sided printing could occur.

Duplex or dual-sided direct thermal printing of transaction documents or receipts is described in U.S. Pat. Nos. 6,784,906 and 6,759,366. The printers were configured to allow printing on both sides of thermal media moving along a feed path through the printer. In such printers a direct thermal print head was disposed on each side of the media feed path. A print head faced an opposing platen across the feed path from the print head.

In direct thermal printing, a print head selectively applies heat to paper or other sheet media comprising a substrate with a thermally sensitive coating. The coating changes color when heat is applied, by which "printing" is provided on the coated substrate. For dual-sided direct thermal printing, the sheet media substrate may be coated on both sides.

Duplex or dual-sided direct thermal printing has been described for providing variable information on both sides of a paper receipt, e.g., to save materials and to provide flexibility in providing information to customers. The printing could be driven electronically or by computer using a computer application program which directs dual-sided printing.

Duplex or dual-sided direct thermal printing as described in U.S. Pat. Nos. 6,784,906 and 6,759,366 involves direct thermal print heads offset from one another while disposed on opposite sides of the media feed path for single-pass, two-sided printing. Unless there is a print head offset, uneven print density can potentially occur. This is because heat energy can be additive if it is applied simultaneously to both sides of the thermal printing paper when the print heads are directly across from one another.

SUMMARY

Dual-sided direct thermal printing of a thermal imaging element having thermally sensitive coatings on opposite sides of a substrate is described, where the thermal imaging element is provided along a feed path of a thermal printer having print heads disposed on opposite sides of the feed path. Printing on both sides of the thermal imaging element is achieved by applying variable energy heat pulses from the opposed print heads. Different energy levels of heat pulses are applied on opposite sides of the thermal imaging element.

DESCRIPTION

By way of example, various embodiments of the invention are described in the material to follow with reference to the included drawings. Variations may be adopted.

Figure 1A:
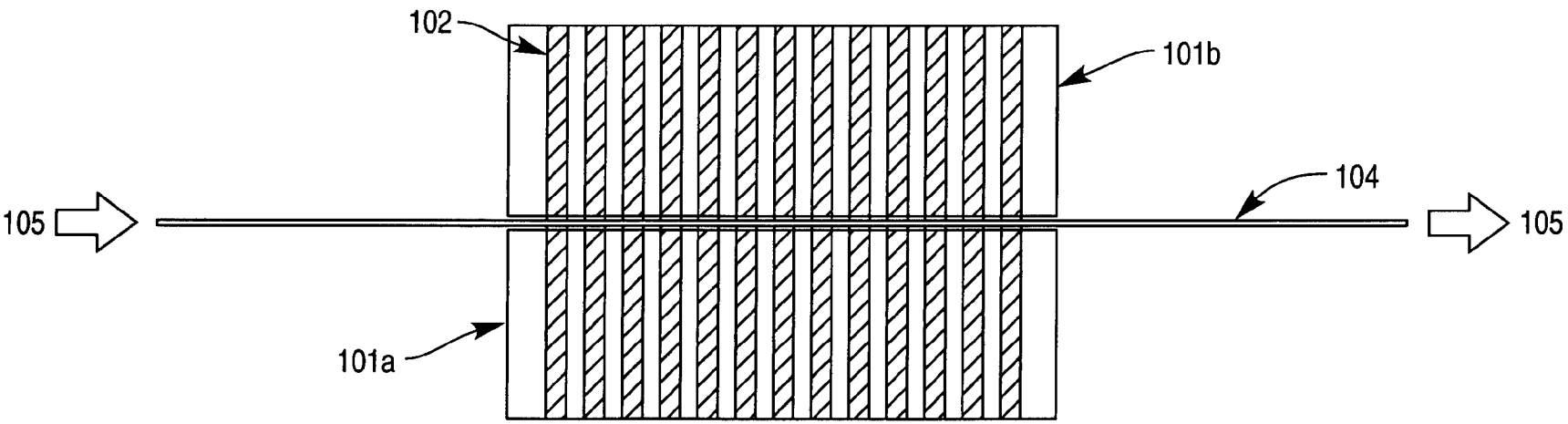
FIG. 1*a* schematically shows opposed print heads for dual-sided direct thermal printing in accordance with one exemplary variation of the invention.
Figure 1B:
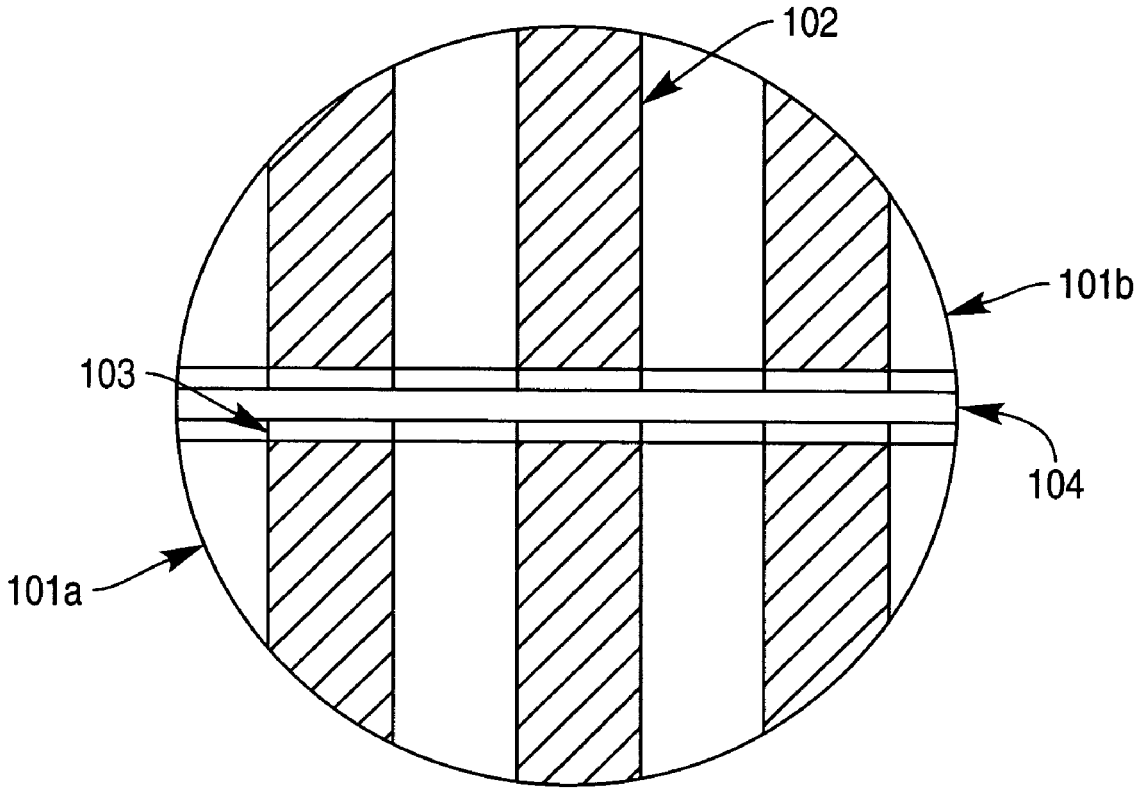
FIG. 1*b* shows schematic detail of the print heads shown in FIG. 1*a*.

FIG. 1*a* of the drawings shows two thermal print heads 101*a* and 101*b* facing each other separated by thermal imaging element 104, e.g., printing paper, provided along a feed path 105. FIG. 1*b* is an exploded partial view of FIG. 1*a*. Resistive printing elements 103 connect to electrical conductors 102. Printing energies of variable energy heat pulses supplied by thermal print-heads 101*a* and 101*b* can add to implement direct thermal printing on one or both sides of the thermal imaging element 104 in a printer.

Two-sided direct thermal printing of front and back sides of thermal imaging element 104 is accomplished by simultaneous use of the adjacent two print heads 101*a* and 101*b* disposed on opposite sides of the feed path 105, e.g., using thermal half-select printing as taught in U.S. Pat. Nos. 3,466,423 and 3,518,406. Thermal print heads 101*a* and 101*b* are energized to provide two available energy levels of heat pulses, and printing of one side of the thermal imaging element 104 is accomplished by use of the higher energy level heat pulses from one of print heads 101*a* and 101*b*. Printing on both sides of thermal imaging element 104 is done by coincident use of lower energy level additive heat pulses from opposed print heads 101*a* and 101*b*.

Figure 2:
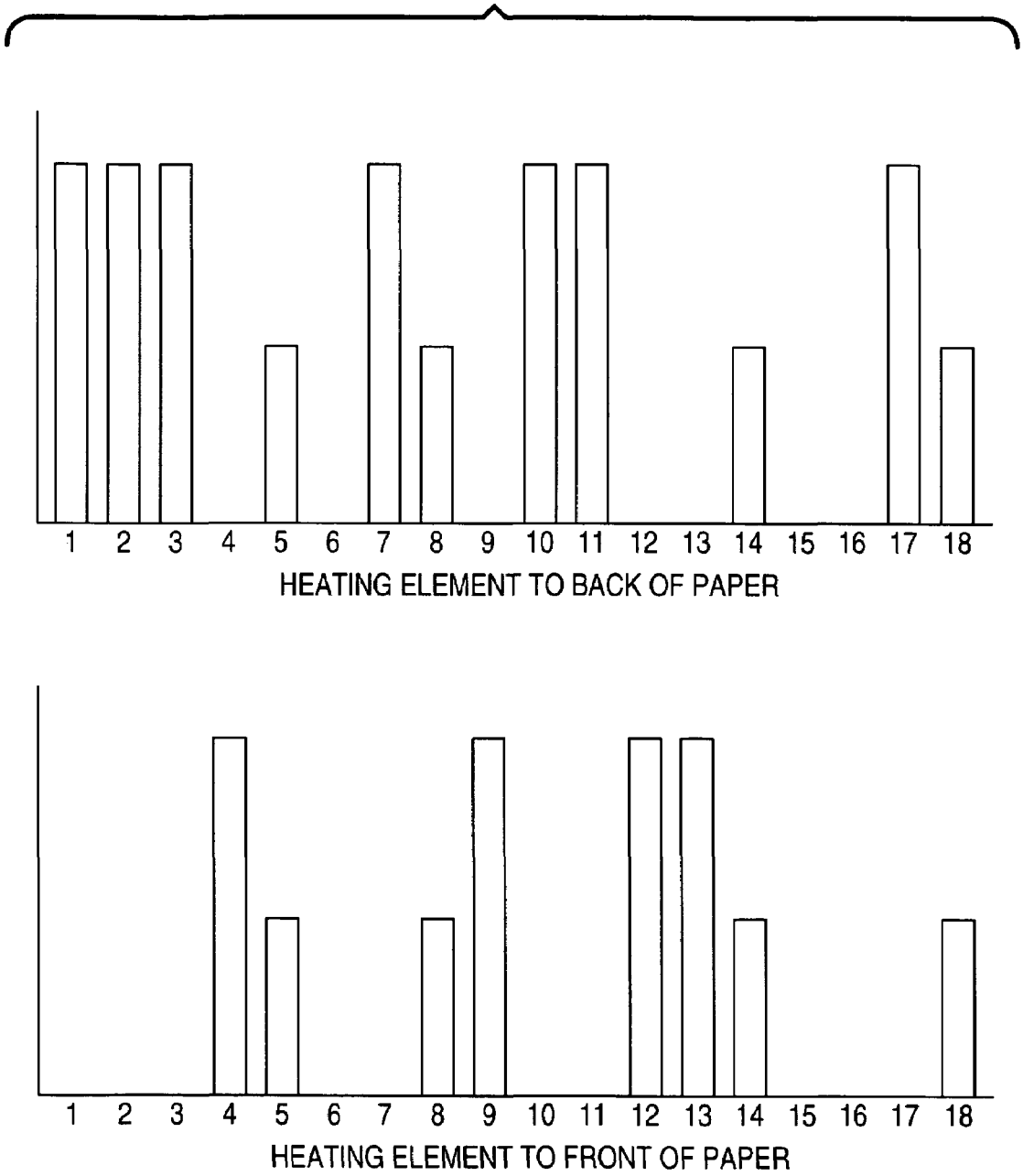
FIG. 2 shows exemplary energy level timing diagrams for heat pulses applied to the front and back of a thermal imaging element for two-sided "half-select" printing.

The charts in FIG. 2 show two-level energies used for direct thermal printing from print heads 101*a* and 101*b* on both sides of thermal printing paper 104. The lower level "half-select" energies are used for "same time-both sides" printing. Printing energy of heat pulses from each of print heads 101*a* and 101*b* is reduced to "half-select" levels when printing is to occur on both sides of the paper 104 at the same time. Otherwise, print density could cause an optical distraction in the area of print were higher energy levels used for simultaneous print on both sides of, e.g., paper 104. The higher heat pulse energy levels shown in FIG. 2 are used for printing on one side only of paper 104.

In printing sequence—from print number 1 to print number 18 shown in FIG. 2, three prints (1-3) are made on the backside; followed by a single print (4) on the front; followed by a print (5) on both sides; followed by no print (6) on either side; followed by a print (7) on the backside; followed by a print (8) on both sides; followed by a print (9) on the front; followed by two prints (10-11) on the backside; followed by two prints (12-13) on the front; followed by a print (14) on both sides; followed by no printing on either side for two time periods (15-16); followed by a print (17) on the backside; and then followed by a print (18) on both sides of the dual-sided thermal imaging element, e.g., paper, 104.

Figure 3:
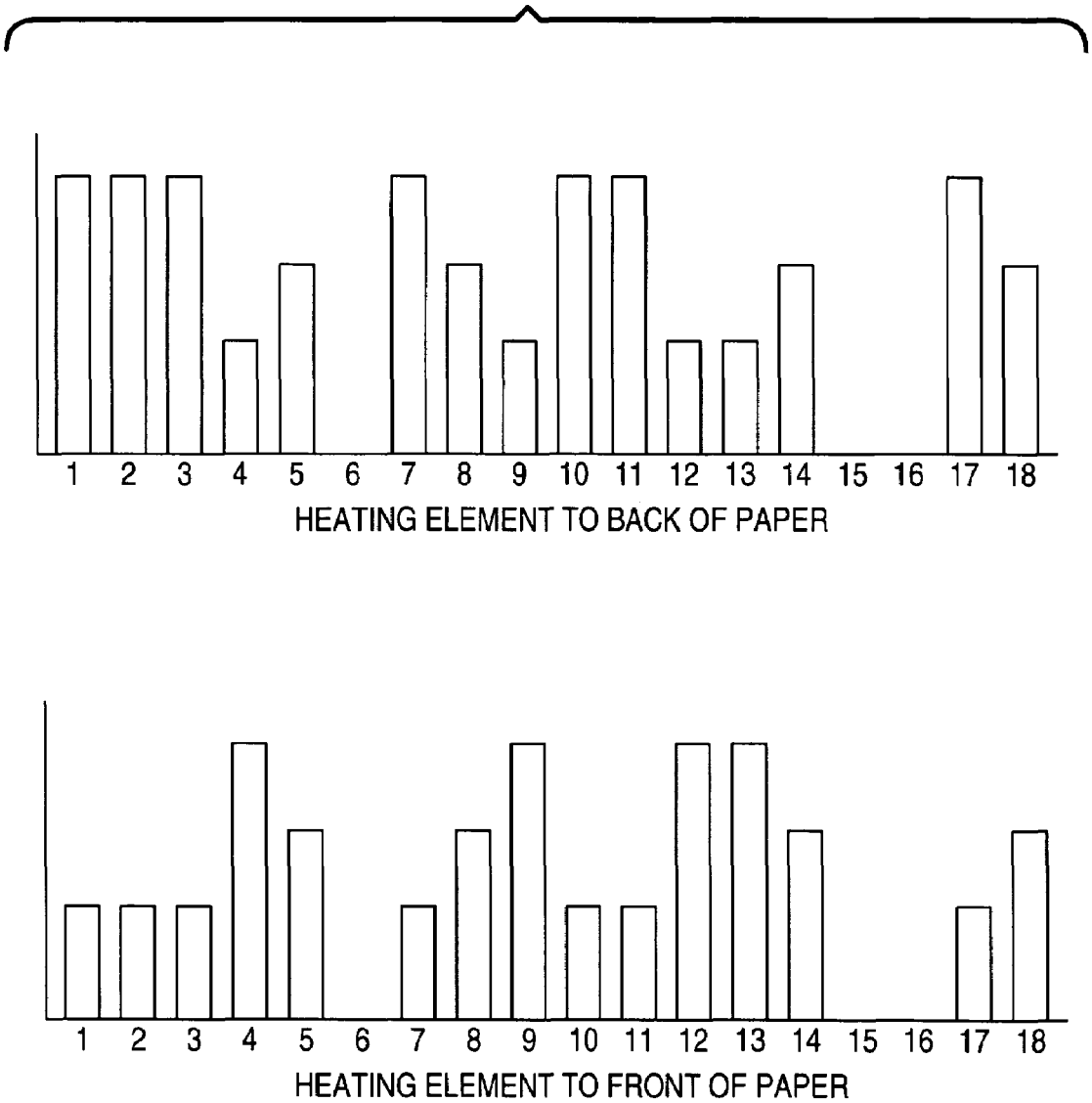
FIG. 3 shows exemplary energy level timing diagrams for heat pulses applied to the front and back of a thermal imaging element for two-sided "partial-select" printing.

Thermal partial-select printing is accomplished in a similar manner except in the case where printing is to occur on one side only of thermal printing paper 104 having a thermal coating on both sides. In this case, coincident energies are applied by the print heads 101*a* and 101*b* in unequal or uneven energy levels with most of the printing energy supplied to the print head on the desired print side of the paper 104 while a lesser amount of energy is supplied by the element on the opposite side of the paper 104. The two energies add and printing occurs on the side of the paper 104 with the greatest energy level applied. FIG. 3 shows exemplary heat pulse energies for partial-select thermal printing.

In the embodiment shown in FIG. 3, three energy levels of heat pulses are supplied from both front and backside print heads 101*a* and 101*b*. Printing cannot occur on either side of the paper 104 without help from both print heads 101*a* and 101*b* simultaneously, based on the selected energy levels chosen. For printing to occur on the front side only of the thermal imaging element 104, a small energy level "partial" heat pulse is generated by the backside print head element while a large energy level "partial" heat pulse is generated by the front print head element. For printing to occur on the backside only, a small energy level "partial" heat pulse is generated by the front side print head while a large energy level "partial" heat pulse is generated by the backside print head. To print on both front and back of the thermal print paper 104, a moderate energy level "partial" heat pulse is generated by both front and backside print heads 101*a* and 101*b*.

In operation, heat pulses are generated by both front and backside printing heads 101*a* and 101*b*. However, in the embodiment of FIG. 3, none of the heat pulses generated by the print heads 101*a* and 101*b* on the front or backside of the thermal paper 104 is chosen to be adequate enough to print a mark on either side of the paper by itself.

In printing sequence—from print number 1 to print number 18 in FIG. 3, three prints (1-3) are made on the backside of thermal imaging element 104; followed by a single print (4) on the front; followed by a print (5) on both sides; followed by no print (6) on either side; followed by a print (7) on the backside; followed by a print (8) on both sides; followed by a print on the front (9); followed by two prints (10-11) on the backside; followed by two prints (12-13) on the front; followed by a print (14) on both sides; followed by no printing on either side for two time periods (15-16); followed by a print (17) on the backside; and then followed by a print (18) on both sides of thermal imaging element 104.

Thermal imaging element 104 may be constructed in a variety of ways, in a known manner, generally including thermally sensitive coatings on opposite sides of a substrate. Thermal imaging element 104 is provided along a feed path 105 of a thermal printer having print heads 101*a* and 101*b* disposed on opposite sides of the feed path 105. Printing on both sides of the thermal imaging element 104 is accomplished by applying variable energy heat pulses from each of the print heads 101*a* and 101*b*. The energy level of a heat pulse from one of the print heads 101*a* and 101*b* can be varied by varying the magnitude of a voltage that produces the heat pulse from the print head. Both sides of the thermal imaging element 104 are printed by coincident application of additive heat pulses from each of the print heads 101*a* and 101*b* as depicted in FIGS. 2 and 3. Printing on opposite sides of thermal imaging element 104 is controlled by the energy level of the heat pulses.

Heat pulses from each of print heads 101*a* and 101*b* can have at least two available energy levels where printing of one side of the thermal imaging element 104 is accomplished by use of higher energy level heat pulses from one of the print heads. Printing of both sides of the thermal imaging element 104 is accomplished by coincident use of lower energy level additive heat pulses from opposed print heads 101*a* and 101*b*.

Where heat pulses from each of print heads 101*a* and 101*b* have at least three available energy levels, printing of one side of the thermal imaging element can be accomplished using the highest energy level heat pulses from one of the print heads and coincident use of the lowest energy level heat pulses from an opposed print head. Printing on one side only of thermal imaging element 104 can be accomplished by coincident use of intermediate energy level heat pulses from opposed print heads 101*a* and 101*b*. Preferably, none of the three available energy levels would be selected to be adequate by itself to print a mark on either side of the imaging element 104. The direct thermal printing on opposite sides of the thermal imaging element 104 is controlled by the timing of heat pulses from print heads 101*a* and 101*b* in this example of dual-sided direct thermal printing.

As taught in U.S. Pat. Nos. 3,466,423 and 3,518,406 to John L. Janning, a print head 101*a* or 101*b* may comprise a first group of parallel resistive heating elements disposed on one side of the feed path 105 and an opposed print head 101*a* or 101*b* may comprise a second group of parallel resistive heating elements disposed on the opposite side of feed path 105, where heating elements of the first heating element group are disposed orthogonally to heating elements of the second heating element group. A dual-sided direct thermal printer is thus constructed in which the opposed print heads 101*a* and 101*b* each comprise electrically resistive thermal printing elements in the form of orthogonal row and column conductors disposed on opposite sides of feed path 105. In such a dual-sided direct thermal printer, the printing occurs where coincidentally energized orthogonal row and column conductors overlap. Alternative dual-sided direct thermal printer constructions may be used, e.g., as illustrated in FIGS. 1*a* and 1*b*, where discrete electrically resistive printing elements 103 in print heads 101*a* and 101*b* may be adjacent one another and disposed on opposite sides of the feed path 105. Dual-sided direct thermal printing on opposite sides of the imaging element 104 is accomplished by coincident current energization of the electrically resistive printing elements 103.

The foregoing description above presents a number of specific embodiments or examples of a broader invention. The invention is also carried out in a wide variety of other alternative ways which have not been described here. Many other embodiments or variations of the invention may also be carried out within the scope of the following claims.

What is claimed is:

1. A method of dual-sided direct thermal printing of a thermal imaging element having thermally sensitive coatings on opposite sides of a substrate, which comprises: providing said thermal imaging element along a feed path of a thermal printer having print heads disposed on opposite sides of said feed path; and printing on both sides of said thermal imaging element by applying variable energy heat pulses from each of said print heads in which both sides of said thermal imaging element are printed by coincident application of additive heat pulses from each of said print heads.

2. The method of claim 1 in which the energy level of a heat pulse from one of said print heads is varied by varying the magnitude of a voltage that produces the heat pulse.

3. The method of claim 1 in which heat pulses from each of said print heads have at least two available energy levels and printing of one side of said thermal imaging element is accomplished by use of higher energy level heat pulses from one of said print heads.

4. The method of claim 3 in which printing of both sides is accomplished by coincident use of lower energy level additive heat pulses from opposed print heads.

5. The method of claim 1 in which heat pulses from each of said print heads have at least three available energy levels and printing of one side of said thermal imaging element is accomplished by use of the highest energy level heat pulses from one of said print heads and coincident use of lowest energy level heat pulses from an opposed print head.

6. The method of claim 5 in which printing on both sides is accomplished by coincident use of intermediate energy level heat pulses from opposed print heads.

7. The method of claim 6 in which none of said three available energy levels is by itself adequate to print a mark on either side of said thermal imaging element.

8. The method of claim 1 in which the direct thermal printing on opposite sides of said thermal imaging element is controlled by the timing of heat pulses from said print heads.

9. The method of claim 1 in which one of said print heads comprises a first group of parallel resistive heating elements disposed on one side of said feed path and another of said print heads comprises a second group of parallel resistive heating elements disposed on the opposite side of said feed path, heating elements of said first group being disposed orthogonally to heating elements of said second group.

10. A method of dual-sided direct thermal printing of a thermal imaging element having thermally sensitive coatings on opposite sides of a substrate, which comprises: providing said thermal imaging element along a feed path of a thermal printer having print heads on opposite sides of said feed path; and printing on a given side of said thermal imaging element by coincident application of unequal energy level heat pulses from each of said print heads.

11. The method of claim 10 in which the printing on opposite sides of said thermal imaging element is controlled by the energy level of heat pulses from said print heads.

12. A method of dual-sided direct thermal printing of a dual-sided thermal imaging element, which comprises: imaging only a single side of said imaging element by coincident application of a first energy level heat pulse to said single side and a second energy level heat pulse to the opposite side thereto, wherein said first energy level is greater than said second energy level, and imaging both sides of said imaging element by coincident application of a third energy level heat pulse to both sides of said imaging element, wherein said third energy level is intermediate said first energy level and said second energy level.

13. A method of dual-sided direct thermal printing in which printing on opposite sides of a dual-sided thermal imaging element is accomplished by coincident current energization of electrically resistive printing elements on opposite sides of said imaging element

14. A dual-sided direct thermal printer comprising directly opposed thermal print heads with printing elements on opposite sides of a feed path for a dual-sided thermal imaging element, in which said printing elements when energized provide variable energy heat pulses to print on dual-sided thermal imaging element.

15. The dual-sided direct thermal printer of claim 14 in which said printing elements print by coincident application of additive heat pulses on opposite sides of said feed path.

16. The dual-sided direct thermal printer of claim 14 in which the energy level of each of said heat pulses is not by itself adequate to print on either side of said imaging element.

17. The dual-sided direct thermal printer of claim 14 in which direct thermal printing on opposite sides of said imaging element is controlled by timing of said heat pulses.

18. The dual-sided direct thermal printer of claim 14 in which said printing elements axe electrically resistive thermal printing elements, and the printing elements comprise orthogonal row and column conductors disposed on opposite sides of said feed path.

19. The dual-sided direct thermal printer of claim 18 in which thermal printing occurs where coincidentally energized orthogonal row and column conductors overlap.

20. The dual-sided direct thermal printer of claim 14 in which said printing elements are electrically resistive printing elements on opposite sides of said feed path.

* * * * *